US007179126B2

(12) United States Patent
Chen

(10) Patent No.: US 7,179,126 B2
(45) Date of Patent: Feb. 20, 2007

(54) ELECTRICAL CONNECTOR WITH IMPROVED TERMINALS

(75) Inventor: Kun-Hua Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/432,827

(22) Filed: May 11, 2006

(65) Prior Publication Data

US 2006/0258218 A1 Nov. 16, 2006

(30) Foreign Application Priority Data

May 16, 2005 (CN) ..... 200510040085

(51) Int. Cl.
*H01R 13/648* (2006.01)

(52) U.S. Cl. ..... 439/607; 439/71

(58) Field of Classification Search ..... 439/607, 439/66, 71
See application file for complete search history.

(56) References Cited

U.S. PATENT DOCUMENTS 5,462,440 A * 10/1995 Rothenberger ..... 439/66
5,484,295 A * 1/1996 Mowry et al. ..... 439/66
5,975,914 A * 11/1999 Uchida ..... 439/66
5,975,959 A * 11/1999 Joly ..... 439/630
6,345,987 B1 * 2/2002 Mori et al. ..... 439/66
6,375,474 B1 * 4/2002 Harper et al. ..... 439/66
6,862,804 B2 * 3/2005 Nishio et al. ..... 29/840
6,923,657 B2 * 8/2005 Brown et al. ..... 439/71
6,939,172 B2 * 9/2005 Lu ..... 439/607
6,994,565 B2 * 2/2006 Harper, Jr. ..... 439/66
7,011,555 B2 * 3/2006 Pan ..... 439/862
7,044,746 B2 * 5/2006 Copper et al. ..... 439/66
7,077,664 B1 * 7/2006 Wang et al. ..... 439/70
7,086,902 B1 * 8/2006 Yang ..... 439/607
7,090,546 B2 * 8/2006 Zheng et al. ..... 439/862
7,097,466 B2 * 8/2006 Asai ..... 439/76.1
7,112,083 B2 * 9/2006 Nishio et al. ..... 439/331
2004/0068868 A1 * 4/2004 Nishio et al. ..... 29/840
2004/0132319 A1 * 7/2004 Richter et al. ..... 439/66
2004/0247311 A1 * 12/2004 Ajiki et al. ..... 396/535
2005/0048829 A1 * 3/2005 Nishio et al. ..... 439/331
2005/0060842 A1 * 3/2005 Ibaraki et al. ..... 16/295
2005/0142917 A1 * 6/2005 Verweg et al. ..... 439/212
2005/0153600 A1 * 7/2005 Lu ..... 439/607
2005/0170674 A1 * 8/2005 Lu ..... 439/66
2005/0215087 A1 * 9/2005 Asai et al. ..... 439/71
2005/0215117 A1 * 9/2005 Asai et al. ..... 439/607
2005/0215118 A1 * 9/2005 Asai et al. ..... 439/607
2005/0219399 A1 * 10/2005 Sato et al. ..... 348/340
2005/0239302 A1 * 10/2005 Wada ..... 439/71
2006/0014405 A1 * 1/2006 Chen et al. ..... 439/78
2006/0024987 A1 * 2/2006 Huang et al. ..... 439/66

(Continued)

*Primary Examiner*—Ross Gushi
(74) *Attorney, Agent, or Firm*—Wei Te Chung

(57) ABSTRACT

An electrical connector (100) includes a shielding member (3), a terminal block (1) positioned adjacent to the bottom of the shielding member (3), a number of terminals (2) received in the terminal block (1). Each terminal (2) includes a end portion (21) securely retained in the terminal block (1), a first branch (211) and a second branch (212) coplanar with the end portion (21) and extending from the end portion (21) towards the same direction parallel to the bottom surface, a tail portion (2110) is located on the first branch (211), and a mating portion (2120) is defined on the second branch (212).

17 Claims, 7 Drawing Sheets

U.S. PATENT DOCUMENTS

2006/0051986 A1* 3/2006 Asai et al. ..... 439/71
2006/0063431 A1* 3/2006 Yang ..... 439/607
2006/0098969 A1* 5/2006 Asai et al. ..... 396/89
2006/0105631 A1* 5/2006 Yang ..... 439/607
2006/0189179 A1* 8/2006 Dittmann et al. ..... 439/74
2006/0189183 A1* 8/2006 Yang ..... 439/95
2006/0189216 A1* 8/2006 Yang ..... 439/680

* cited by examiner

ELECTRICAL CONNECTOR WITH IMPROVED TERMINALS

BACKGROUND OF THE INVENTION

1. Field of the Invention

The present invention relates to an electrical connector, and particularly to an electrical connector used for a mobile phone or other electrical devices having different designs and configurations.

2. Description of the Prior Art

With the rapid development of the technology of wireless communication and advanced technology of electrics, electronic consuming products such as mobile phone, Personal Digital Assistant (PDA) etc., are designed to comply with miniaturization trend and multiple functions such as mounting a camera thereon to meet with requirements of human. As a result, socket connectors for accommodating the cameras therein are correspondingly demanding.

Usually, these electrical connectors used for accommodating and electrically connecting the camera with the consuming products each provides a plurality of terminals engaged with an insulative housing in a way of assembling. Please refer to a conventional electrical connector shown in FIG. 1, each terminal 2' comprises a body portion 21', a resilient portion 22' bent and extending upwardly from an end of the body portion 21', a contacting portion 23' formed on distal free end of the resilient portion 22' and disposed above body portion 21', a locking portion 24' perpendicularly located on the other end of the body portion 21' and a connecting portion 25' joined the body portion 21' and the locking portion 24'. The locking portion 24' engages with the insulative housing 10' and assures the terminal 2' be retained in the housing 10' reliably. The contacting portion 23' contacts with the bottom of a camera module 4' by means of the upwardly elastic force. However, such terminals result in the high profile of the connector along the mating direction, and thus increasing the thickness of the consuming products.

Hence, an improved electrical connector is desired to overcome the disadvantages of the prior art.

BRIEF SUMMARY OF THE INVENTION

Therefore, a main object of the present invention is to provide an electrical connector having low-profile.

To fulfill the above-mentioned object, an electrical connector according to the present invention comprises a shielding member defining a receiving space for receiving an electrical device therein, a terminal block positioned adjacent to the bottom of the shielding member for electrical interconnection with the electrical device, a plurality of terminals assembled to the terminal block. Each terminal comprises an end portion securely retained with the terminal block, a mating section adapted for electrically with the electrical device and a tail portion for mounting on a print circuit, and wherein each terminal further comprises a first branch and a second branch coplanar with the end portion and extending from the end portion towards the same direction parallel to a bottom surface of the terminal block, said tail portion is located on the first branch, said mating section is formed on the second branch.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
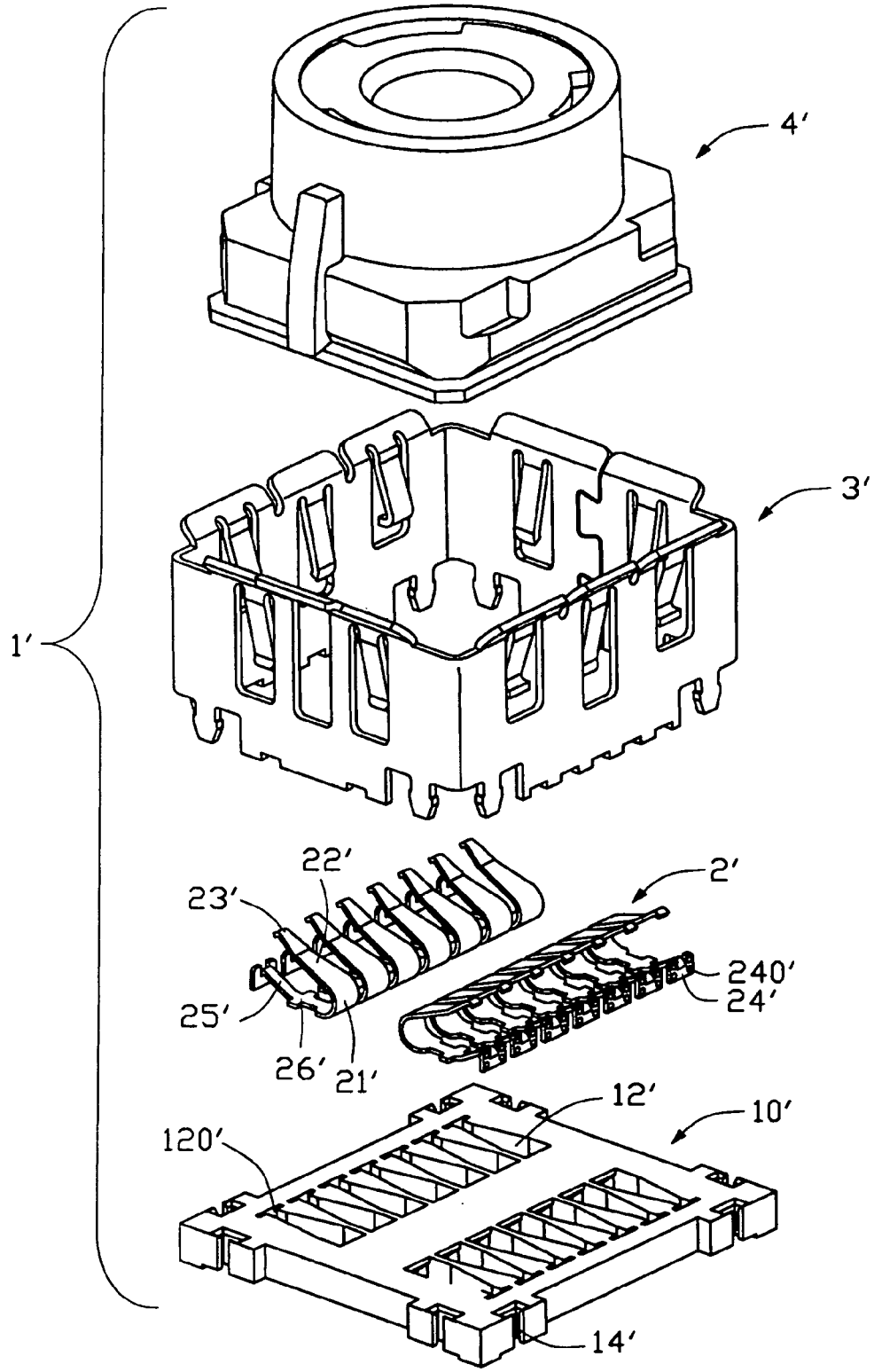
FIG. 1 (PRIOR ART)
FIG. 1 is an exploded view of a conventional electrical connector.
Figure 2:
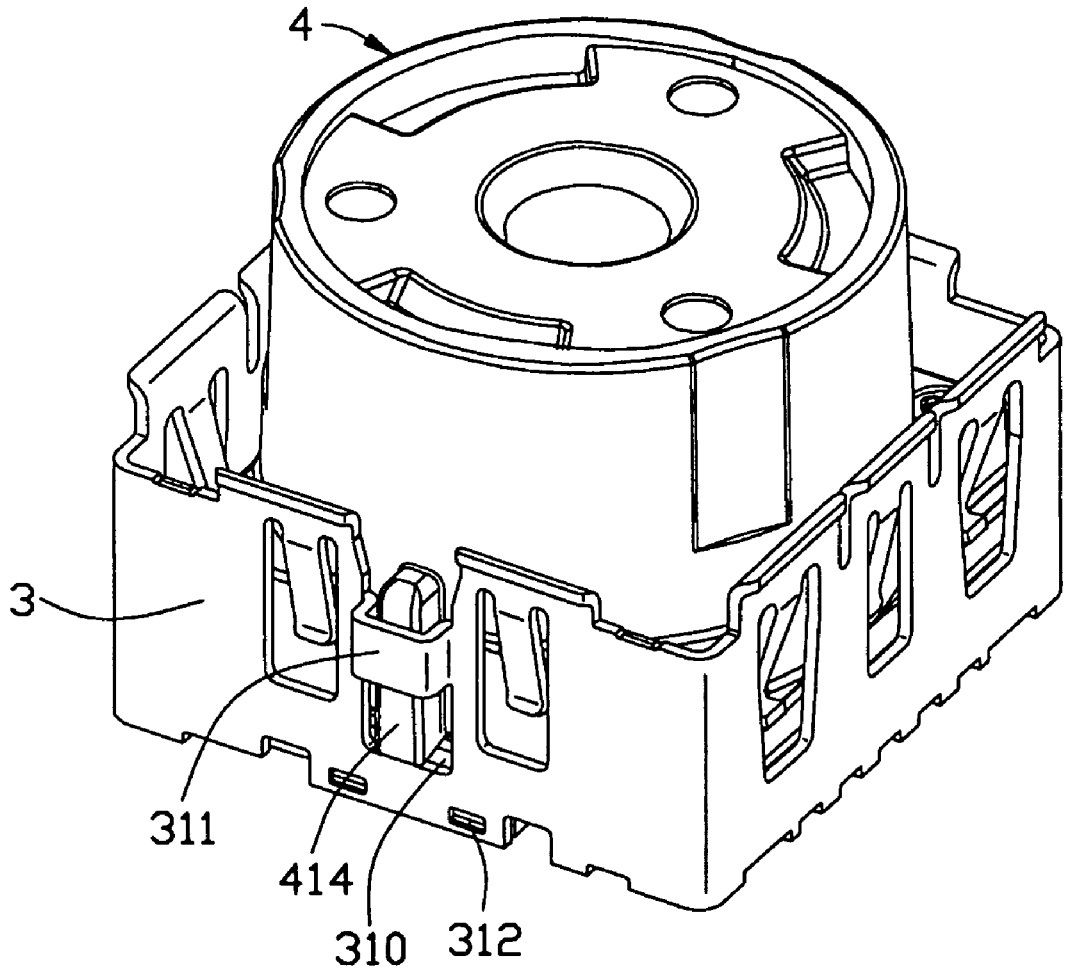
FIG. 2 is an assembled perspective view of an electrical connector with an electrical device according to the present invention.
Figure 3:
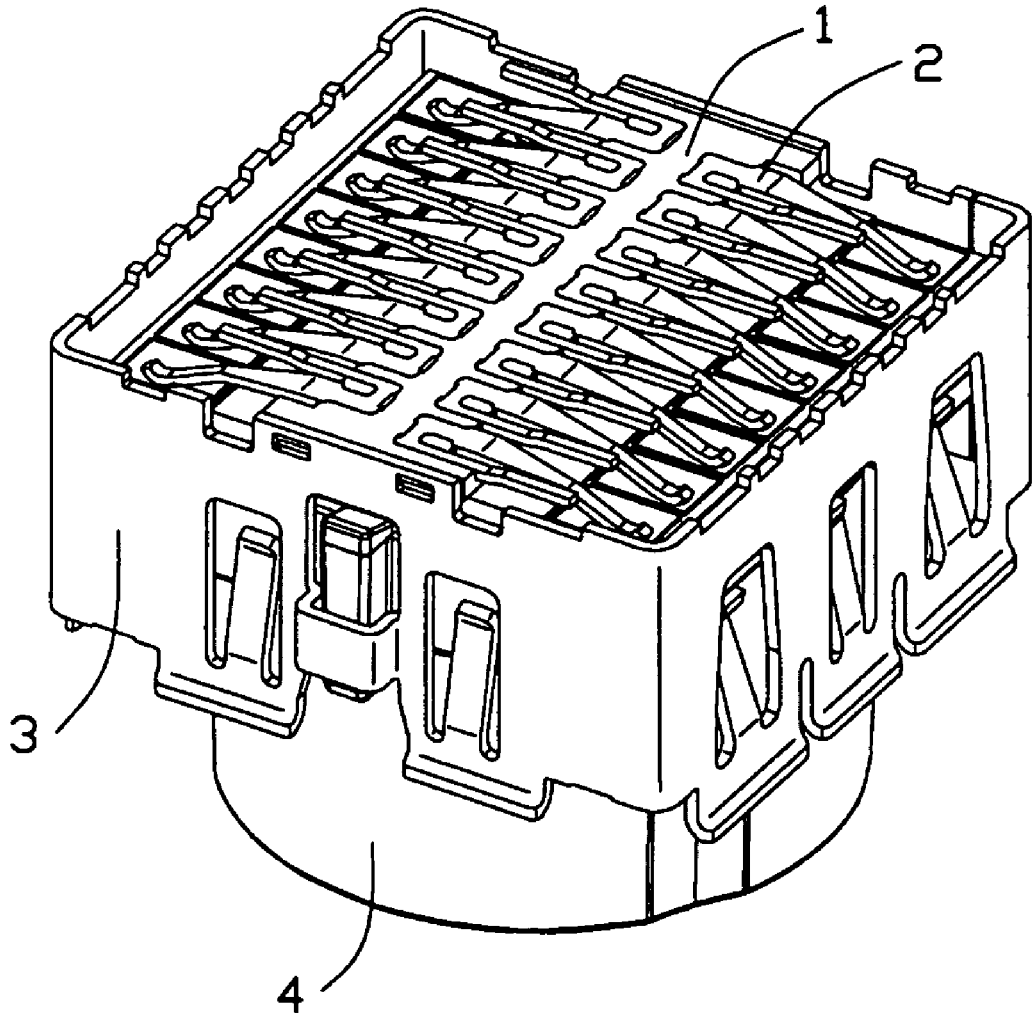
FIG. 3 is a view similar to FIG. 2, but viewed from another aspect.

Reference will now be made in detail to the preferred embodiment of the present invention.

Referring to FIGS. 2–7, an electrical connector 100 according to the present invention is adapted for receiving an electrical device which is a camera module 4 in the present embodiment. The electrical connector 100 comprises a shielding member 3 accommodating the camera module 4, a plurality of terminals 2 and an insert-molding terminal block 1. The terminal block 1 is positioned adjacent to the bottom of the shielding member 3.

The terminal block 1 dimensioned to receive the plurality of terminals 2 therein includes a rectangular main body 11 and a pair of side portions 13 respectively disposed at opposite ends of the main body 11. A plurality of recessed passageways 12 are arranged into two rows along the longitudinal direction of the bottom surface of the main body 11 and each passageway 12 is recessed upwardly from the bottom surface of the main body 11 with opening toward front or rear edges of the main body 11. Each passageway 12 forms a heave 15 in the central section thereof and each heave 15 is of irregular shape. Each side portion 13 comprises a pair of projections 14 spaced arranged on outer edge thereof along a lateral direction of main body 11 for coupling with the shielding member 3.

Each terminal 2 includes an end portion 21, a first branch 211 and a second branch 212 both being coplanar with the end portion 21 and bifurcating from the end portion 21 towards the same direction parallel to the bottom surface of the terminal block 1. The end portion 21, the first branch 211 and the second branch 212 are stamped from a strip. The first branch 211 has a tail portion 2110 extending along a direction away from the end portion 21, and the second branch 212 has a resilient portion 2120 extending upwardly therefrom and along a direction away from the end portion 21. The resilient portion 2120 has a curved mating section 2121 at a free end thereof. With the pre-pressure, the mating section 2121 can still provide a larger resisting force even if at a lower height when the mating section 2121 is pressed downwardly, therefore, the mating section 2121 can reliably and electrically connect with the camera module 4. The end portion 21, the first branch 211 and the second branch 212 together form a retaining hole 210 for receiving the heave 15 of the passageway 12. A recess 24 is dispose on the bottom side of the end portion 21 to strength the engagement with the terminal block 1 after the terminal 2 insert-molded with the terminal block 1. The terminals 2 of the electrical connector 100 according to present invention are reversely disposed at two rows, and thus, a certain distance L is provided to make sure that the terminals 2 can reliably engage with the terminal block 1 after insert-molding.

The shielding member 3 is firstly stamped from a metal sheet and then bent to form a rectangular configuration shown in the present invention. The shielding member 3 includes a first wall, a second wall, a third wall, a fourth wall 31, 32, 33, 34 which connect with one another in turn to form a receiving space 30. A swallow-tail shaped jointing line 300 is formed near the jointing portion of the third wall 33 and the fourth wall 34. The first wall 31 comprises a U-shape cutout 310 defined in a central section thereof and recessed downwardly from a up edge thereof, a U-shaped connecting portion 311 protruding outwardly and connecting to two opposite sides of the cutout 310, a pair of resilient tabs 313 symmetrically located at two opposite sides of the cutout 310 respectively and bent inwardly into the receiving space 30, a pair of apertures 312 defined in a low portion of the first wall 31 and a guide portion 314 curved outwardly from a top edge of the first wall 31. The cutout 310 includes a bottom edge 370 and the width of the top portion of the cutout 310 is slightly lager than that of the bottom edge 370. The U-shaped connecting portion 311 is stamped from the first wall 31 and connecting with two opposite sides of the cutout 310. The U-shaped connecting portion 311 can overcome the limitation of the low intension caused by the cutout 310 located in the first wall 31, and furthermore the width of the first wall 31 will not be increased since the connecting portion 311 is stamped from the first wall 31. The resilient tab 313 comprises a jointing portion 3130 connecting to the guide portion 314, a main portion 3131 connecting to the jointing portion 3130 and bent toward the third wall 33 of the shielding member 3 and a sustaining portion 3132 resisting against the camera module 4. The second and the fourth walls 32, 34 each comprises a resilient tab 313 located on the central section thereof, two clasping arms 320 symmetrically located at two sides of the resilient tab 313 and three guide portions 314 respectively connecting with the resilient tab 313 and the clasping arm 320. The third wall 33 comprises a pair of resilient tabs 313, a pair of guide portions 314 connecting to the resilient tab 313 and a pair of apertures 312 located in the low portion of the third wall 33. The resilient tabs 313 of the four walls 31, 32, 33, 34 can symmetrically fix the camera module 4 and establish a grounding connection for the electrical connector 100. The clasping arms 320 of walls 32, 34 can reliably lock the camera module 4 within the shielding member 3. The guiding portion 314 can easily guide the camera module 4 to be assembled into the shielding member 3.

Figure 4:
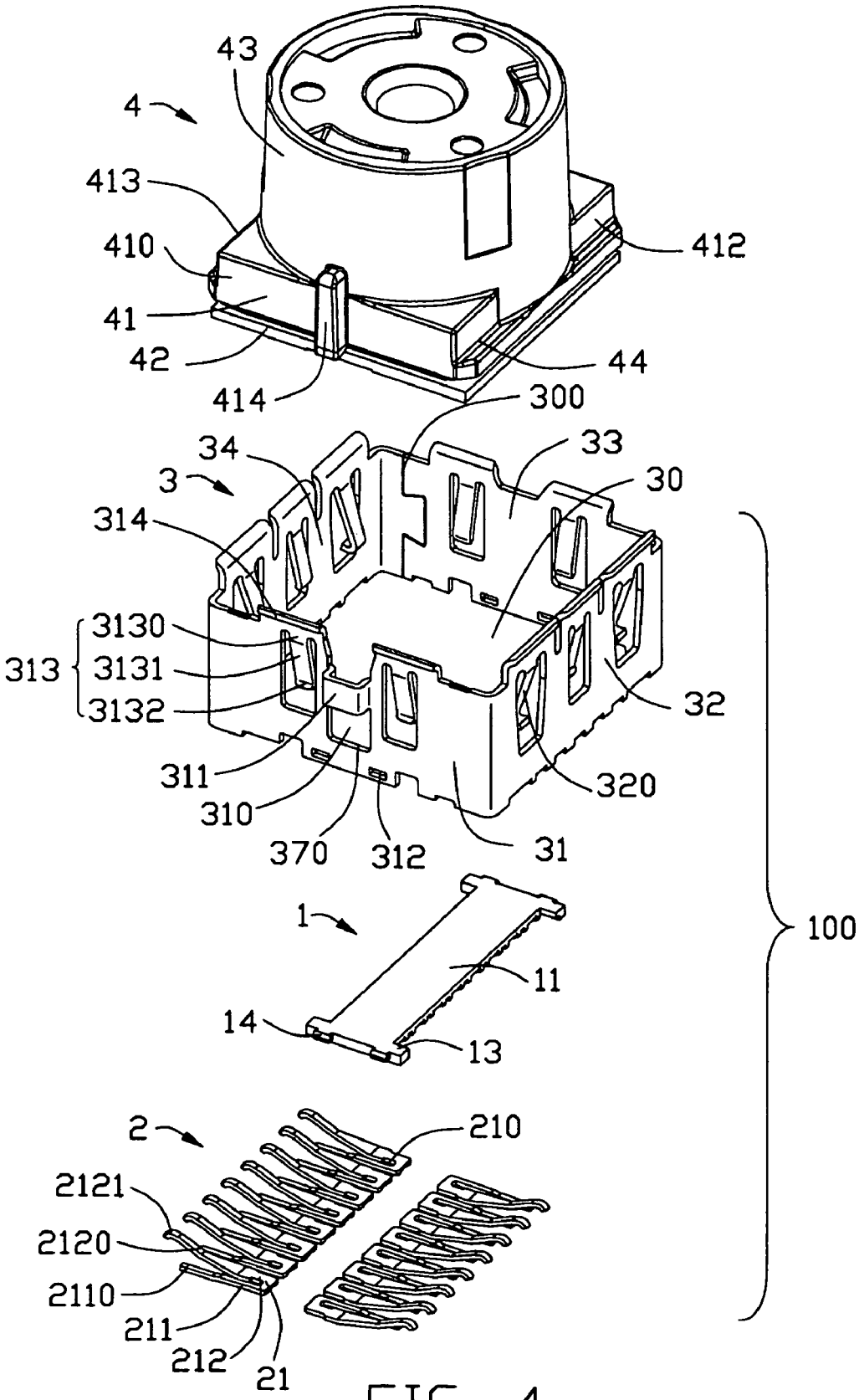
FIG. 4 is an exploded, perspective view of FIG. 2.
Figure 5:
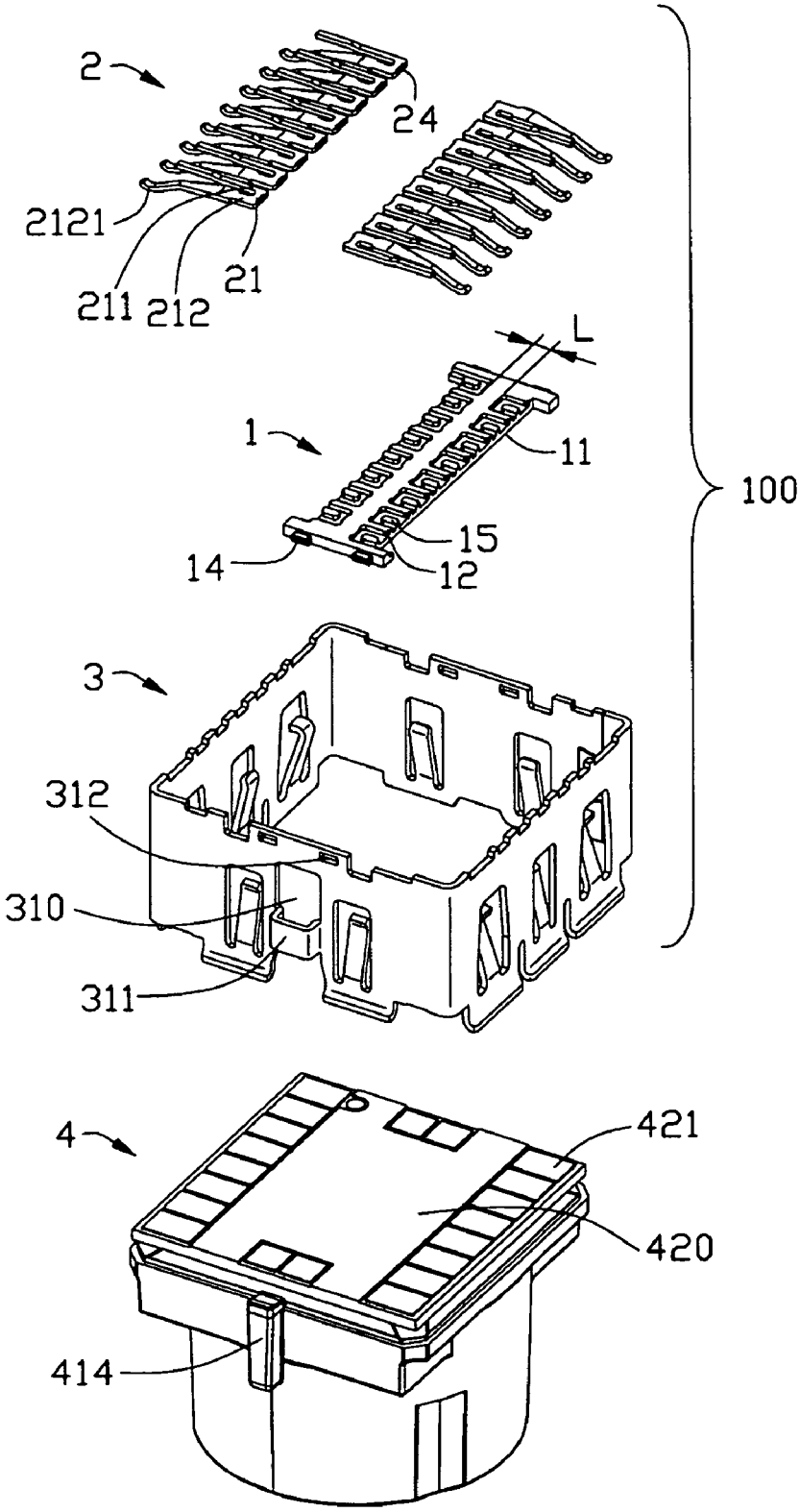
FIG. 5 is a view similar to FIG. 4, but viewed from another aspect.
Figure 6:
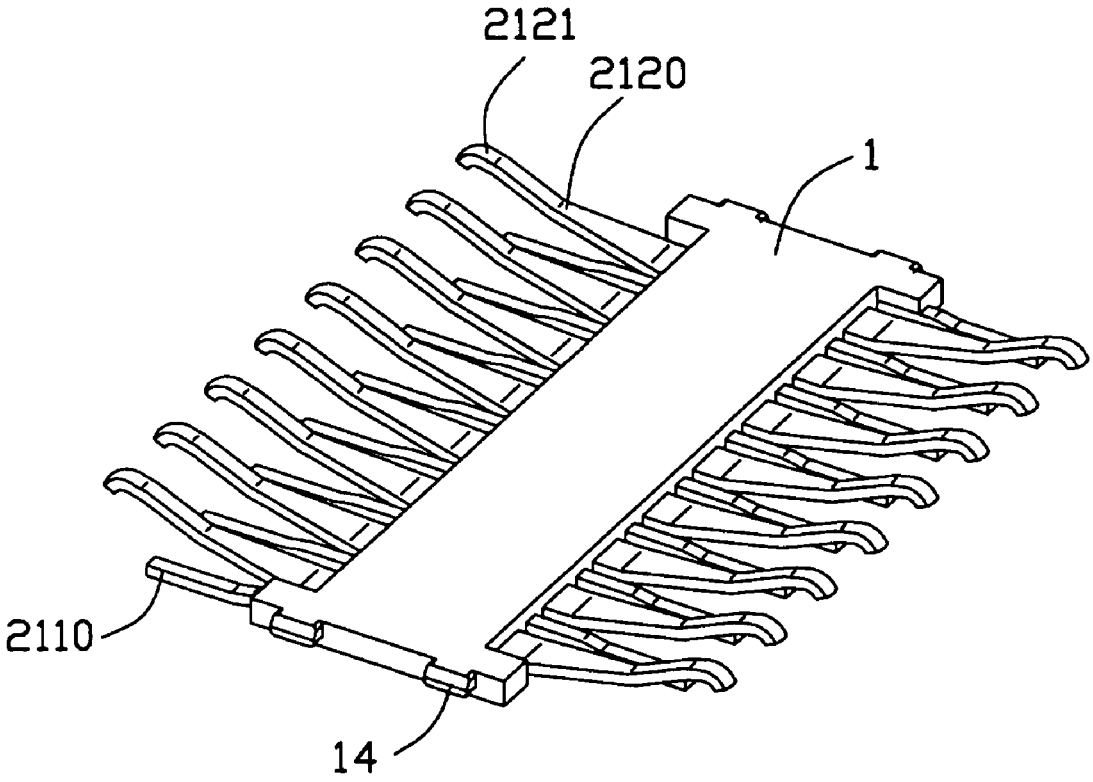
FIG. 6 is a perspective view of a terminal block assembled with a plurality of terminals.
Figure 7:
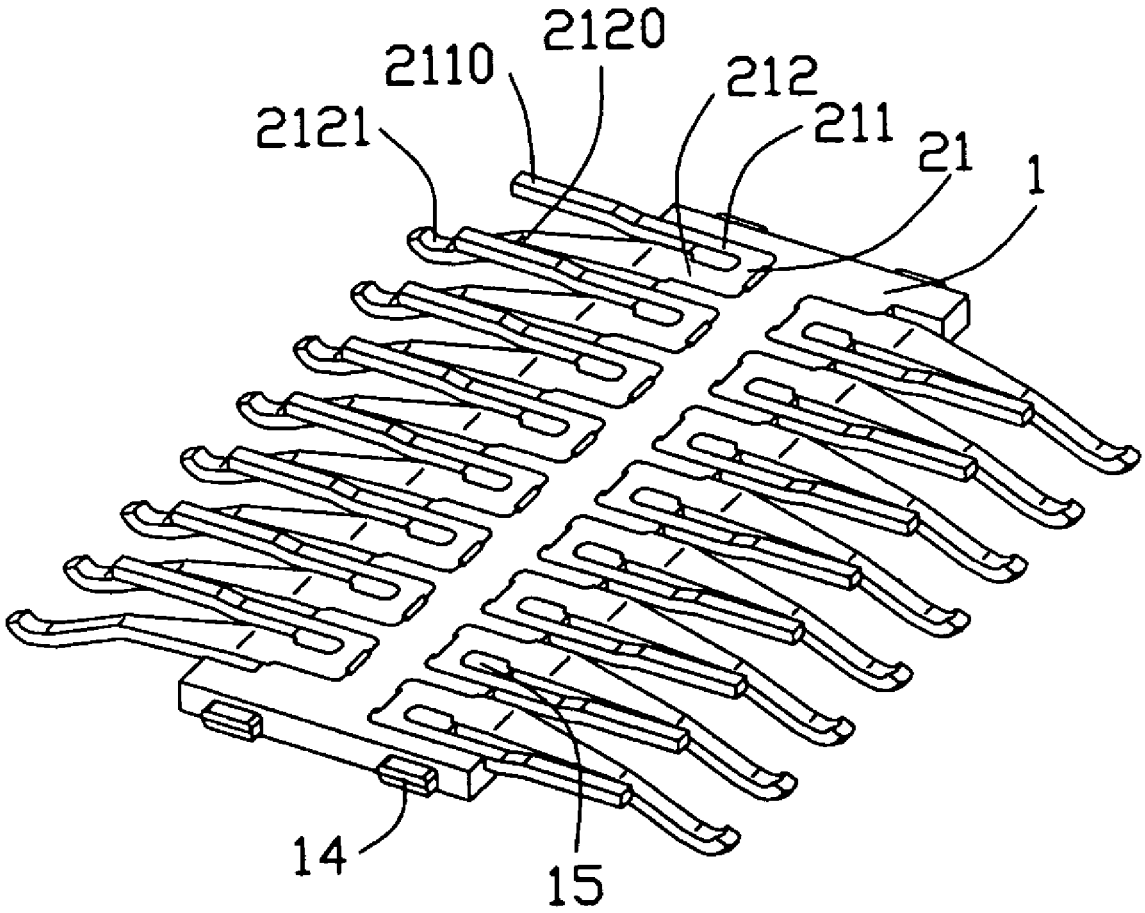
FIG. 7 is a view similar to FIG. 6, but viewed from another aspect.

The camera module 4, received in the receiving space 30 of the shielding member 3, comprises a rectangular body portion 41, a columnar portion 43 situated on the top of the body portion 41 and a bottom portion 42 located beneath the body portion 41. The body portion 41 includes a front wall 410, two side walls 412, 413 adjoined to the front wall 410, and a back wall (not labeled) opposite to the front wall 410. The side walls 412, 413 each defines a ladder-shaped clasping notch 44 for locking with the clasping tab 320. Referring to FIG. 4, the front wall 410 of the body portion 41 provides an approximately longitudinal rib 414 which may insert into the cutout 310. When the camera module 4 is shocked, the rib 414 abuts against the bottom edge 370 and is received in the U-shape region of the connecting portion 311, so the camera module 4 will not move downwardly. A conductive layer enclosed around the columnar portion 43 can establish an electrical connection with the resilient tabs 313 of the shielding member 3. The bottom surface of the bottom portion 42 has a plurality of conductive pads 421 contacting with the mating sections 2121 of the terminals 2.

In assembly, referring to FIGS. 2–7, firstly, the terminals 2 are arranged in two rows in a mold, and then the melting plastic material flows between the space of the two rows of the terminals 2. The melting plastic material flows into the retaining holes 210 to from the heaves 15. The recesses 24 of the terminals 2 are also filled with the melting plastic material to strength the retaining force between the terminals 2 and terminal block 1. After cool, the terminal block 1 with a plurality of terminals 2 assembled therein is formed. The end portions 21 of the terminals 2 are received in the passageways 12 of the terminal block 1. The mating sections 2121 of the terminals 2 extend upwardly from the main body 11 and the end portions 21 of the terminals 2 are beneath the main body 11. Particularly referring to FIG. 7, the end portions 21 and the first and second branches 211,212 are coplanar with the bottom surface of the main body 11, while the 2110 below the bottom surface of the main body 11 for soldering. Then, the terminal block 1 with the terminals 2 is assembled to the shielding member 3 with the projections 14 of the side portions 13 of the terminal block 1 received in the apertures 312. The camera module 4 is inserted into the receiving space 30 of the shielding member 3 along a top-to-bottom direction. In the meanwhile, the rib 414 of the camera module 4 is pressed into the cutout 310 of the shielding member 3 due to the pressure caused by the resilient tabs 313 and the clasping arms 320. In the process of moving downwardly, the rib 414 engages with the cutout 310. The resilient tabs 313 press against the outer periphery of the columnar portion 42, and the clasping arms 320 engage with the clasping notches 44. Thus, the camera module 4 is accommodated and supported by the shielding member 3, and can not be moved by shock. After the camera module 4 is inserted, the conductive pads 421 of the bottom portion 43 of the camera module 4 electrically connect with the contacting portions 21 of the terminals 2 placed in the terminal block 1.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a shielding member defining a receiving space for receiving an electrical device therein;

a terminal block positioned adjacent to the bottom of the shielding member for electrical interconnection with the electrical device;

a plurality of terminals assembled to the terminal block, each terminal comprising an end portion securely retained with the terminal block, a mating section adapted for electrically with the electrical device and a tail portion for mounting on a print circuit, and wherein each terminal further comprising a first branch and a second branch coplanar with the end portion and extending from the end portion towards the same direction parallel to a bottom surface of the terminal block, said tail portion is located on the first branch, said mating section is formed on the second branch.

2. The electrical connector as described in claim 1, wherein the terminals are stamped from a strip.

3. The electrical connector as claimed in claim 1, wherein the terminals are insert-molded with the terminal block.

4. The electrical connector as claimed in claim 1, wherein the tail portion locates below the bottom surface of the terminal block, and the mating section extends upwardly beyond a top surface of the terminal block.

5. The electrical connector as claimed in claim 1, wherein the terminal block efines a plurality of passageways on the bottom surface thereof, said plurality of terminals are received in said passageways, the end portion, the first branch and the second branch of each terminal together form a retaining hole, and wherein the terminal block defines a heave filling the retaining hole.

6. The electrical connector as described in claim 1, wherein the terminals are arranged in two rows, the tail portions and the mating sections of the same row of the terminals are located at the same side of the terminal block.

7. The electrical connector as claimed in claim 6, wherein the terminal defines a recess opposite to the first and second branches toreliably engage with the terminal block.

8. The electrical connector as claimed in claim 6, wherein the terminal block having a main body and a pair of side portions respectively disposed at opposite ends of the main body, and each side portion defines at least one projection.

9. The electrical connector as claimed in claim 8, wherein the shielding member defines at least one aperture engaging with the at least one projection of the terminal block.

10. The electrical connector as claimed in claim 1, wherein said shielding member comprises first, second, third and fourth shielding walls connecting with one another in turn, and the first wall comprises a cutout and a U-shaped connecting portion protruding outwardly and connecting to two opposite sides of the cutout.

11. The electrical connector as claimed in claim 10, wherein the first, the second, the third and the fourth walls each having at least a resilient tab adapted for pressing against the outer periphery of the electrical device.

12. An electrical connector comprising:

a terminal block having an insulative piece holding therein a plurality of terminals oppositely arranged in opposite first and second rows, each of said terminals defining an end portion with first and second branches extending and bifurcating therefrom generally along a same direction, a tail section downwardly extending from the first branch, a contacting section upwardly extending from the second branch; and the terminals of said two rows being arranged in an alternate/zigzag manner so that the second branches of the two opposite terminals in said first and second rows are essentially aligned with each other in said direction while the corresponding first branches of said two opposite terminals in said first and second rows are offset from each other in said direction.

13. The connector as claimed in claim 12, wherein said terminal block defines a plurality of heaves each located between the first and second branches.

14. The connector as claimed in claim 12, wherein the end portion is exposed to an exterior downwardly.

15. An electrical connector comprising:

a terminal block having an insulative piece holding therein a plurality of terminals oppositely arranged in opposite first and second rows, each of said terminals defining an end portion with first and second branches extending and bifurcating therefrom generally along a same direction, a tail section downwardly extending from the first branch, a contacting section upwardly extending from the second branch; and the terminals of said two rows being arranged in an opposite manner so that for the every two opposite terminals respectively located in said first and second rows, at least either the corresponding first branches or the corresponding second branches are offset from each other in said direction.

16. The connector as claimed in claim 15, wherein said terminal block defines a plurality of heaves each located between the first and second branches.

17. The connector as claimed in claim 15, wherein the end portion is exposed to an exterior downwardly.

* * * * *